US009112621B1

(12) United States Patent
Mishra et al.

(10) Patent No.: US 9,112,621 B1
(45) Date of Patent: Aug. 18, 2015

(54) DETERMINISTIC RANKING OF A PROPERTY REQUIRING SATELLITE SERVICE WITHOUT ACTUALLY VISITING THE PROPERTY

(71) Applicant: The DIRECTV Group, Inc., El Segundo, CA (US)

(72) Inventors: Aditya P. Mishra, Redondo Beach, CA (US); Saranathan Govindarajan, Artesia, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 191 days.

(21) Appl. No.: 13/771,505

(22) Filed: Feb. 20, 2013

(51) Int. Cl.

| | |
|---|---|
| ***H04H 20/74*** | (2008.01) |
| ***H04H 40/90*** | (2008.01) |
| ***H04H 40/18*** | (2008.01) |
| *H04H 60/13* | (2008.01) |

(52) U.S. Cl.
CPC ..... *H04H 40/90* (2013.01); *H04H 40/18* (2013.01); *H04H 60/13* (2013.01)

(58) Field of Classification Search
CPC ..... H04H 40/18; H04H 60/13
USPC ..... 455/3.02, 3.01, 3.03, 3.04, 3.05, 3.06, 455/466, 414.1–414.4, 456.1–457, 422.1, 455/403, 418–420, 427–429, 500, 517, 455/550.1; 725/62–72, 105, 106, 109, 110, 725/131
See application file for complete search history.

(56) References Cited

U.S. PATENT DOCUMENTS

| | | | | |
|---|---|---|---|---|
| 5,808,583 | A * | 9/1998 | Roberts | 342/359 |
| 2012/0040663 | A1 * | 2/2012 | Kamdar et al. | 455/425 |
| 2012/0040664 | A1 * | 2/2012 | Kamdar et al. | 455/425 |

* cited by examiner

*Primary Examiner* — Keith Ferguson

(57) ABSTRACT

A service-ability system determines a probability of a proper installation of satellite broadcast reception equipment at a given location. A method for determining service-ability comprises accessing data related to a given location via a computer, assigning a weight and a value to each accessed data point with the computer, compiling the values of each accessed data point, and comparing the compiled values to a predetermined probability threshold.

16 Claims, 5 Drawing Sheets

400

| Attribute | Description | Weight | For New Address | For Existing Address |
|---|---|---|---|---|
| Geocoded Address | "Key to service-ability" | 50 | X | |
| Visual Inspection | "CSR's view" | 20 | X | |
| Trees | "Customer and CSR's view" | 20 | X | |
| Existing Service Record | Reason for lack of service drives service-ability | 100 | | X |
| Nearby Service Record | Drives probability of getting DIRECTV signal | 30 | X | X |
| Southern Exposure | Drives | 100 | X | |

402 404 406 408 410 412 414 416

FIG. 4

DETERMINISTIC RANKING OF A PROPERTY REQUIRING SATELLITE SERVICE WITHOUT ACTUALLY VISITING THE PROPERTY

BACKGROUND

1. Technical Field

The present disclosure relates generally to installation of broadcast reception equipment, and in particular, to predicting likelihood of success of servicing a particular location before visiting that location.

2. Description of Related Art

Satellite and other wireless broadcasting of communications signals has become commonplace. Satellite distribution of commercial signals (e.g., for use in television programming) typically entails provisioning a customer location with an Outdoor Unit (ODU), including, e.g., a dish antenna and supporting electronics for delivery of services such as television programming, data services, and two-way internet connections, to name a few.

FIG. 1 illustrates a typical satellite-based broadcast system of the related art. System 100 uses Satellite A (SatA) 102, Satellite B (SatB) 104, and Satellite C (SatC) 106 to broadcast signals to an Outdoor Unit (ODU) 108 that is typically attached to the outside of a house 110. ODU 108 receives these signals and sends the received signals to a receiver 112, also known as a Set Top Box (STB) or Integrated Receiver Decoder (IRD) 112 with house 110. Receiver 112 decodes and separates the signals into viewer channels, which are then passed to monitor 114 for viewing by a user. There can be more than one satellite transmitting from each orbital location (slot). The orbital slots are typically designated by their longitude. For example, a satellite 102 located in the orbital slot at 101 degrees West Longitude (WL) is usually referred to as transmitting from "101."

Satellite uplink signals 116 are transmitted by one or more uplink facilities 118 to the satellites 102-106 that are typically in geosynchronous and geostationary orbit in their assigned orbital slots, although other orbital trajectories can also be used. Satellites 102-106 typically amplify and rebroadcast the uplink signals 116, through transponders located on the satellite, as downlink signals 120. Depending on the antenna pattern of satellite 102-106, the downlink signals 120 are directed towards geographic areas for reception by the ODU 108. These geographical areas may, for example, encompass the entire Continental United States (CONUS). Satellites 102-106 may also contain spot beams that only service specific portions of CONUS. Satellites 102-106 may also be placed in orbit such that the downlink signals 120 are transmitted to other geographical areas, such as Latin America, Europe, etc.

Each satellite 102-106 may broadcast downlink signals 120 in, e.g., thirty-two (32) different frequencies, which are licensed to various users for broadcasting of programming. Downlink signals 120 may include, for example, audio, video, or data signals, or any combination of the foregoing. These signals are typically located in the Ku-band of frequencies, i.e., 11-18 GHz, but can also be broadcast in the Ka-band of frequencies, i.e., 18-40 GHz (typically 20-30 GHz). Signals can also be delivered from uplink facilities 118, or other locations within system 100, to receiver 112 via other connections 122, e.g., internet connections, cable connections, fiber optic connections, or other wireless connections to receiver 112. Receiver 112 can also be coupled to a network 124, which can be a local area network within house 112 or a wider network such as the internet. As such, receiver 112 can receive and transmit signals via network 124 and additional connections 122 as desired.

Even if satellites 102-106 are designed for CONUS coverage, or for spot beam coverage within a particular geographical area, there may be portions of the designated area that will have natural and/or manmade obstructions which block or interfere with reception of the satellite downlink signals 120, or other difficulties impacting satellite service. Such locations may also have difficulty receiving other wireless signals that are associated with the satellite services, in a similar fashion to cellular telephone coverage. Although cellular carriers design the cellular system to service large geographic areas, there are "dead spots" within those areas that receive poor or no coverage within that system. Similar problems exist within wireless broadcast systems, because of obstructions, multipath issues, other interferences with the downlink signal 120, and other issues that may or may not be readily visible. Typically, a service technician is sent to the location to visually and electronically (e.g., with meters and other equipment) determine whether downlink signal 120 can be received properly at a given location. However, this approach is expensive and time consuming.

It would be advantageous to be able to determine the capability of a particular location to receive downlink signals 120 and other wireless signals associated with system 120, preferably quickly and without visiting the location.

SUMMARY

To minimize the limitations in the prior art, and to minimize other limitations that will become apparent upon reading and understanding the present specification, embodiments of methods and apparatus for determining the probability of a proper installation of satellite broadcast reception equipment at a given location are disclosed herein.

A method in accordance with one or more embodiments comprises accessing data related to the given location via a computer, assigning a weight and a value to each accessed data point with the computer, compiling the values of each accessed data point, and comparing the compiled values to a predetermined probability threshold.

A system for determining a probability of a proper installation of satellite broadcast reception equipment at a given location in accordance with one or more embodiments, may comprise a geocoder for determining a geocode for the given location, a server coupled to the geocoder for accessing data points associated with the given location, and a tagger for assigning a weight and a value to each accessed data point. The server may compile the values of each accessed data point and compare the compiled values to a predetermined probability threshold.

Proper installation may be determined for a specific requested service. The data related to the given location may comprise proprietary data of a service provider. The accessed data may be determined through a web-based questionnaire. Examples of the data related to the given location may include a street address, exposure of the given location in a given direction, prior services provided to the given location, and/or obstructions at the given location. Pieces of accessed data may be weighted differently based on a type of requested service. The probability may be determined prior to performing a site survey of the given location. When the comparison of the compiled values fails to meet the predetermined probability threshold, a site survey of the given location may be requested.

Other features and advantages are inherent in the methods and apparatus disclosed or will become apparent to those skilled in the art from the following detailed description and its accompanying drawings.

BRIEF DESCRIPTION OF THE DRAWINGS

Referring now to the drawings in which like reference numbers represent corresponding parts throughout:

FIG. 4 is a chart illustrating an example of the assignment of different weights to different attributes in accordance with one or more embodiments.

DETAILED DESCRIPTION

Figure 1:
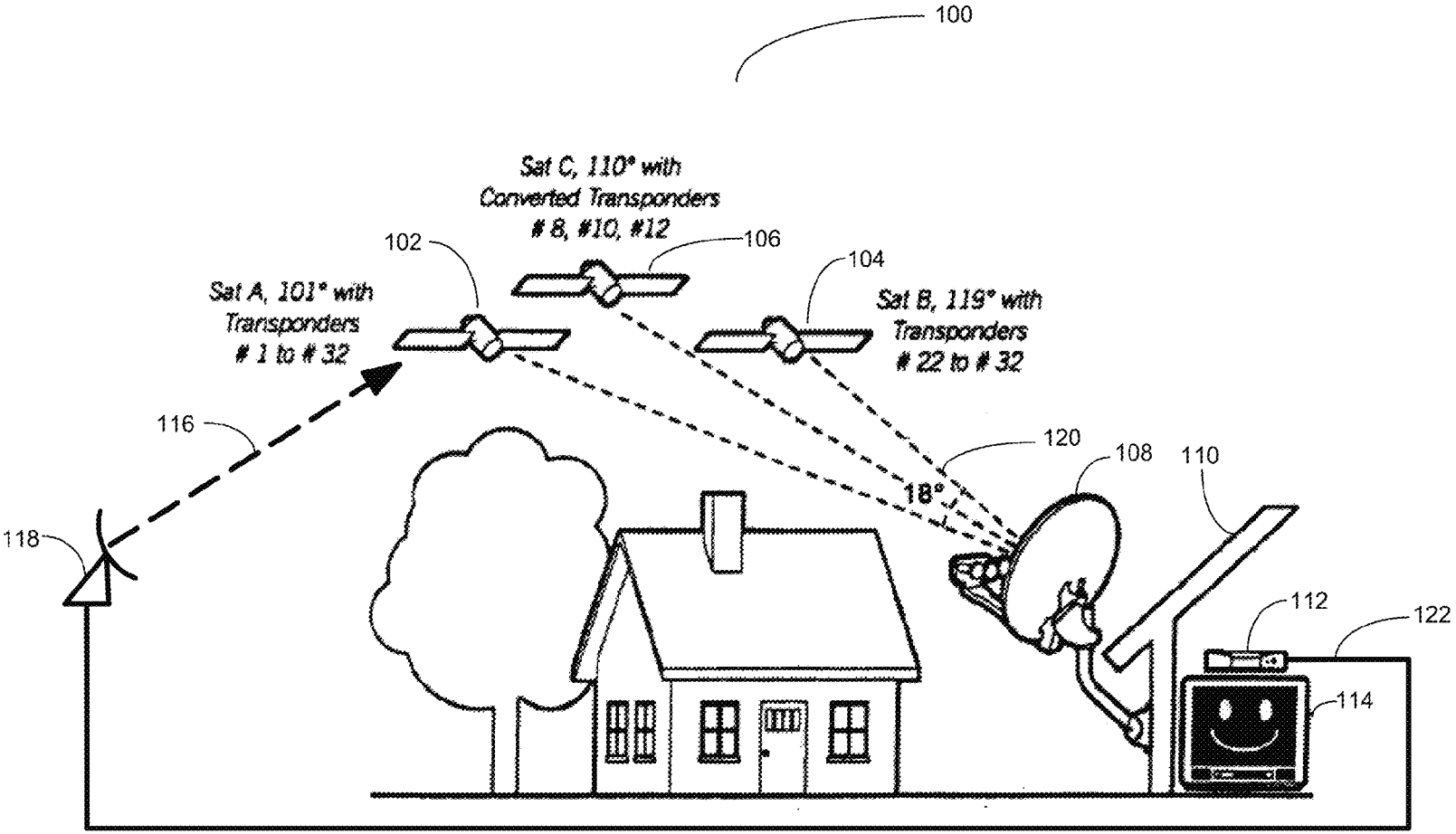
FIG. 1 illustrates a typical satellite-based broadcast system of the related art.

In the following description, reference is made to the accompanying drawings that form a part hereof, and which, by way of illustration, show one or more example embodiments. It is understood that other embodiments may be utilized and structural changes may be made without departing from the scope of the present disclosure.

Overview

The embodiments described herein provide a way to determine if a location is serviceable for satellite service without actually visiting the location or property. In one or more embodiments, the service-ability system makes use of data that is publicly as well as privately available to determine the "service-ability" of a location for Satellite service installation. Service-ability is, essentially, the probability of a successful installation at a given residence or property of signal reception antennas and other equipment such that the satellite services that are desired at that residence or property can be properly received.

The service-ability system uses data that is associated with the property or location that is available from various sources to determine this probability. Each piece of data may be specifically weighted to provide additional accuracy for the predictions made for a given residence or piece of property.

As such, the service-ability system provides a probability of successful service not only to the service provider, but can also offer this probability of successful service delivery to the public and/or the person requesting that service be provided to a given property or residence. So, for example, and not by way of limitation, a person can access a website for a service provider and put in their address, or some other geographical designation such as longitude and latitude, and the service-ability system can report directly to the person requesting the information the probability of success for installation of equipment at that location in terms of receiving the services being requested. Each service being requested can have a different outcome based on the service being requested, in that each service can have, and likely will have, different pieces of data that will affect service delivery and/or can have different weightings on the data points being used to determine the probability of successful installation for that residence or location.

As such, rather than requesting a site survey from the service provider, which would cost the service provider time and money to perform, a potential customer can use the service-ability system to perform, essentially, a "self-survey" of the proposed site, prior to even making any calls to the service provider to initiate service. If the service is likely not available, such a potential customer may still request a site survey, but if the probability is high that service is available, a site survey may not be necessary. Such probabilities, and the data that was used to determine the probabilities, can also be forwarded to the service provider to determine, prior to any actual visits to the site, what possible solutions can be implemented to perform a successful installation such that the services requested can be delivered. As such, the service-ability system provides a service to the general public to determine if they can receive satellite broadcasting without actually requesting a site survey of their property.

Further, the service-ability system can also provide, in addition to the above advantages, an efficiency service and prioritization service for the service provider technicians that will install the equipment, as well as any service technicians that may have to visit the property in the future or any call center personnel that may receive a call from a customer regarding service interruptions at a given property, to help determine what problems the installation at the requested property may encounter, the probabilities of success of delivering the requested services at the property, as well as providing initial troubleshooting data to service technicians after the equipment is installed at a given property or residence. Thus the service-ability system ultimately reduces the cost of the supply chain and installation costs for a service providers operations and maintenance departments.

Methodology for Determining Probabilities of a Successful Installation

In one or more embodiments, the service-ability system assigns and, optionally, progressively fine tunes the probability of a successful installation based on publicly available and company private data attributes that are available for a property. The discussion herein merely lists some of the possible data points that are available; other data points can be utilized in the methodology without departing from the scope of the present disclosure.

Height of the Property

If the property has a relatively high elevation, e.g., Denver, Colo., there may not be many obstacles between the property and other obstructions. Of course, height of a given property is merely relative to the height of the surrounding structures, trees, or topography, so such an attribute may not be given much weight in any given probability determination.

Exposure in the Direction of the Signal Source

To receive the signal, the antenna or other receiving device must have an exposure in the direction that the signal is being transmitted from. In many satellite systems, this direction is toward the southern sky, e.g., pointing toward the equator from North American installations, because the signal source is typically a satellite that is in geostationary orbit at a given longitude that is in a southern direction with respect to the receiving antenna. However, some locations may need a northern exposure, e.g., installations south of the equator, or the satellite may only be in geosynchronous orbit which creates an analemma-shaped area that the receiving antenna must be able to view, or the satellite may be in another orbital pattern, e.g., an elliptical pattern, in which case larger portions of the sky must be unobstructed or have reduced obstructions with respect to the receiving antenna. The service-ability system utilizes the known location of the signal sources, e.g., satellites 102-106, and/or other sources and their movements across the sky with respect to the property requesting services, and compares these sources with the exposure that a given property has with respect to these sources to determine probability of a successful installation of receiving equipment.

So, for example, and not by way of limitation, other satellite services, such as two-way internet services, may be delivered from a satellite at 95 WL, while broadcast television services are delivered from satellites 102-106 that are located between 99 WL and 119 WL. The service-ability system may calculate a different probability for successful installation for a property that is requesting broadcast television services than for the same property that is requesting two-way internet services, and the service-ability system may also further fine-tune such probabilities for those channels of broadcasting services that are transmitted from satellite 106 at 119 WL. The data being used to determine the exposure of the property in question to the signal source(s) for the services to be delivered can be derived from several sources: Google Earth, longitude/latitude/altitude (geopositional coordinates) of the property, proprietary data such as knowledge of the location (s) and transmitting power of the signal sources, etc.

Azimuth

The azimuth (longitude) of a given property is important in that the signal sources, e.g., satellites 102-106, are at relatively fixed longitudes, and thus, a greater difference between longitudes of the property and the signal sources creates not only a longer signal path, which reduces signal strength at the receiving antenna, but also requires a larger swath of unobstructed volume for the receiving antenna to point into.

Obstructions Near and Around the Property

The property may also be close to large buildings that create multipath problems or other reception issues that affect the elevation angle required by an antenna placed at the property. A specific elevation angle is required for proper signal reception, which affects the probability of a successful installation. Further, if the property is in a wooded area, or if other obstructions exist that could reduce the signal quality or signal strength for a given installation, the service-ability system can take these into account in determining the probability of a successful installation.

Permits Available for the Property

The service provider may have prior or proprietary knowledge that certain locations are not permitted to receive certain services. For example, and not by way of limitation, if the property is an apartment building, and prior tenants in the apartment building have attempted to access services from the service provider and have been denied, although the property in question can physically receive the signals for the requested services, it may not be possible for the service provider to install the proper equipment at that location because the building owner will not permit such installations.

Further, certain services cannot be delivered to certain locations because of contractual or other commitments. Again, by example and not by way of limitation, a person might request a service that is "blacked out" at the property because of the geographical location of the property (e.g., a broadcast station that broadcasts local games regardless of sellout or other league rules for use in other parts of the country). Such requests for services, although the signals are present, could be denied by the service-ability system because of contractual or other rules not known or understood by the requesting party or, perhaps, even by the technicians installing the equipment.

Proximity of the Property to Other Properties Receiving Service

If there are nearby properties that are currently receiving service successfully from the same service provider, or there are nearby properties that formerly received service successfully from the same service provider, then the probability of a successful installation may be increased in one or more embodiments.

Further, and not by way of limitation, it is possible to use, as a data point, the successful delivery to nearby properties of other services by other service providers to determine the probability of successful service delivery and a successful installation of equipment. For example, and not by way of limitation, a satellite broadcast provider might use the successful delivery, past or present, of other satellite broadcast providers' services to nearby locations to determine if services can be successfully delivered and equipment can be successfully installed at a given location. Such data points may have different weightings than successful delivery of their own services and installations in any probability calculations made by the service-ability system.

Street Address

The street address of the property may also be used to determine the probability of a successful installation because certain addresses may be known to have difficulties with respect to installation locations. Typically, street addresses can be converted to longitude/latitude/altitude coordinates via Geographic Information Systems (GIS) databases, and thus these coordinates can be compared not only to other successful installations nearby, but can be compared to previous installations at a given address to determine probability of another installation at the same address.

Failure of Service for Other Reasons

The property in question may physically be outside of the service area for a given service provider. For example, although satellites 102-106 typically have a CONUS antenna pattern for transmission, areas just outside of the United States, e.g., Windsor, Ontario, Canada, just south of Detroit, can probably receive service from satellites 102-106 as well as other broadcast signal delivery systems. However, because satellites 102-106 are designed to generate a specific beam pattern, other places in Canada, e.g., Ottawa, Ontario, may have a smaller probability of successfully receiving the signals and thus the probability of a successful installation in Ottawa is typically less likely than in Windsor. Other reasons, such as urban canyons associated with specific addresses, beam pattern degradation in certain geographic areas, etc., can also contribute to the weighting and/or usage of this data in determining probabilities using the service-ability system.

Hardware and Software Environment

Figure 2:
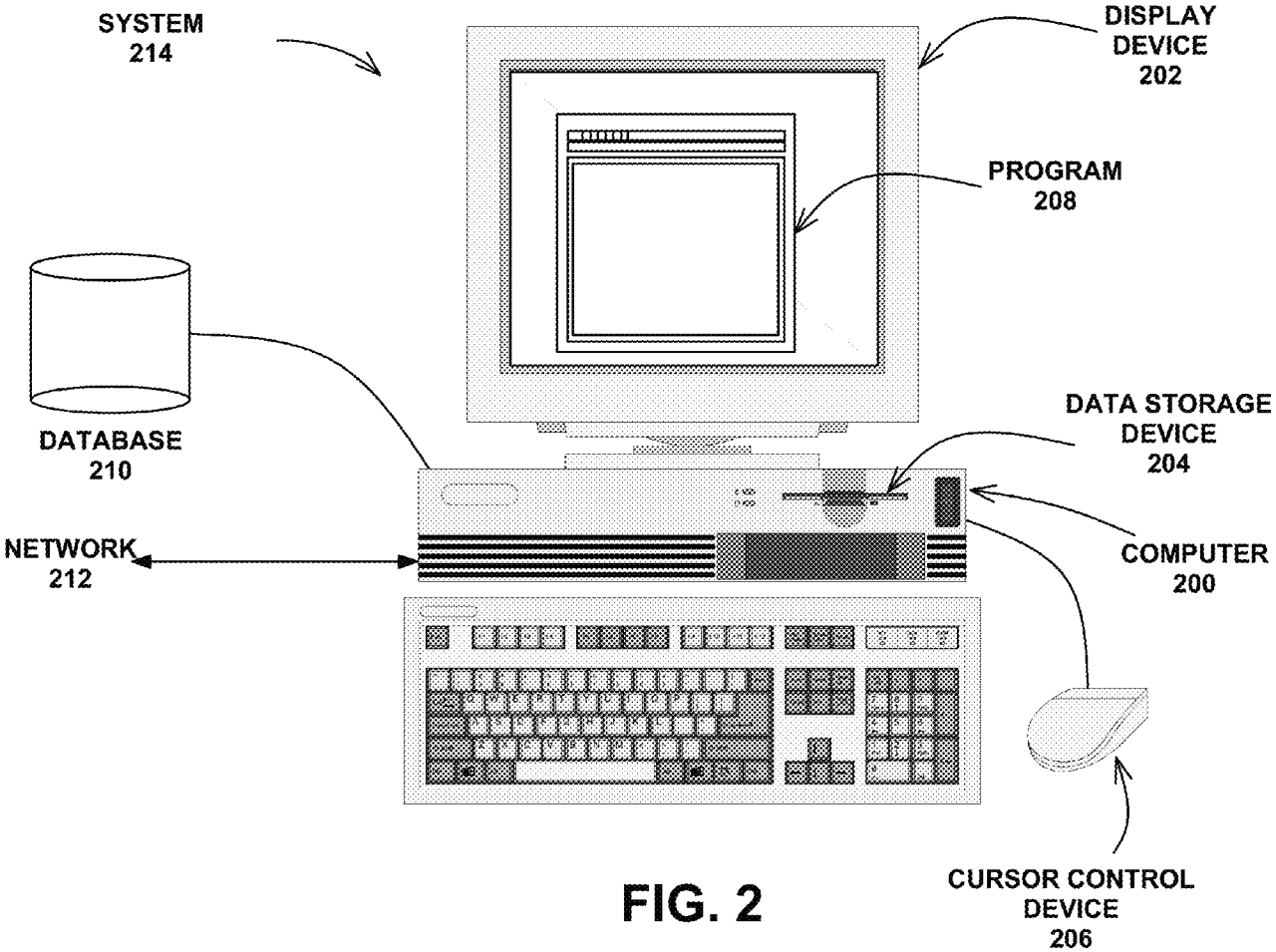
FIG. 2 is an example of a hardware and software environment that can be used to implement one or more embodiments.

FIG. 2 is an example of a hardware and software environment that can be used to implement one or more embodiments of the service-ability system.

Embodiments may be implemented using a computer 200, which generally includes, inter alia, a display device 202, data storage devices 204, cursor control devices 206, and other devices. Those skilled in the art will recognize that any combination of the above components, or any number of different components, peripherals, and other devices, may be used with the computer 200.

One or more embodiments of the service-ability system may include a computer-implemented program 208, wherein the program 208 is represented by a window displayed on the display device 202.

Generally, the program 208 comprises logic and/or data embodied in or readable from a device, media, carrier, or signal, e.g., one or more fixed and/or removable data storage devices 204 connected directly or indirectly to the computer 200, one or more remote devices coupled to the computer 200 via a data communications device, etc. Further, the program 208 may utilize a database 210 such as a spatial database.

Computer 200 may also be connected to other computers 200 (e.g., a client or server computer) via network 212 comprising the Internet, LANs (local area network), WANs (wide area network), or the like. Computer 200 can also be connected to receiver 112 via network 124 shown in FIG. 1, if such a connection is desired. Further, database 210 may be integrated within computer 200 or may be located across network 212 on another computer 200 or accessible device.

Those skilled in the art will recognize that the exemplary system illustrated in FIG. 2 is not intended to limit the present disclosure. Indeed, those skilled in the art will recognize that other alternative systems may be used without departing from the scope of the present disclosure.

Applicability of the Service-Ability System

The service-ability system not only applies to direct satellite broadcast services supplied by system 100 as described herein, but can also apply to additional services that are available through system 100. Such services may include "online" channels, which can be available to mobile telephones and other devices through cellular wireless telephone carrier services, internet-accessible channels that are either delivered through satellites 120 and receiver 112, or other wired or wireless connections, to a computer 200 via network 124 or through direct connection of computer 200 to receiver 112, and accessed through one or more software programs 208 on computer 200, e.g., RIO or RIO lite. Further, the service-ability system can also be applicable to commercial dealer channels, for example and not by way of limitation, a supply chain management channel which allows for distribution of goods or services, a dealer website or customer service channel that allows individuals to access dealer information or request service at their location, etc. The service-ability system allows for knowledge of where such supply chain management channels will and will not be available at specific locations, which aids in placement of such distribution points. Further, if customer service channels are not available at a given location, such a location might not want to have service installed because of the known and almost certain high frequency of service/repair visits to that location.

Determining Service-Ability

Figure 3:
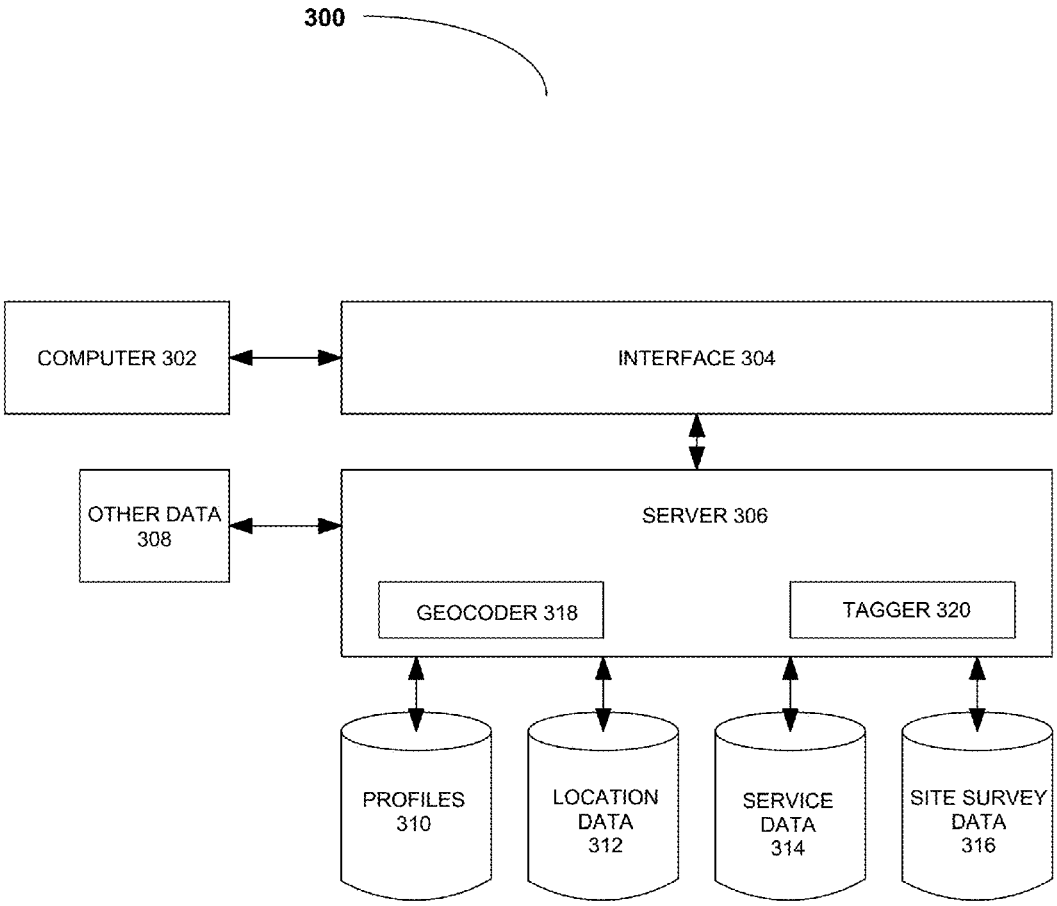
FIG. 3 is a system block diagram showing one or more possible embodiments of a service-ability system.

FIG. 3 illustrates a block diagram showing one or more possible embodiments of a service-ability system.

To determine service-ability for a property, a potential subscriber to satellite-based services can access system 300 via a computer 302, or can contact a satellite-based service provider who would access the system 300 via computer 302. Within system 300 is a computer interface 304, which processes the input information provided from computer 302.

Interface 304 allows for computer 302, and thus any user or service provider accessing computer 302, to input data points which are then sent to server 306. Typically, the data that is input into computer 302 is a street address, but can be other information such as longitude and latitude, for example. Further, input data typically comprises the types of service that are being requested for installation, e.g., satellite television service, satellite internet service, or other satellite-based services.

Interface 304 accepts the input data from computer 302 and makes a request from server 306 based on the input data. Server 306 then accesses several databases 308-316 to see if there are data points that would be relevant to determination of a probability of adequately providing the requested services to the street address/location input from computer 302. So, for example, and not by way of limitation, the server 306 may take the input street address data and access a mapping service, e.g., Google Maps, and request a satellite image or map of the address input to the computer 302. The interface 304 may request that the user acknowledge that the satellite map accurately portrays the address input to computer 302 before accessing other databases 308-316. If the user states that the satellite image data is incorrect in some way, interface 304 may access additional data or request additional input data to properly identify the errors in the satellite image or may forward the request to the service provider such that there can be additional assistance provided to determine an adequate installation.

Once the address and location is optionally confirmed by computer 302, interface 304 and server 306 then access databases 308-316 to gather any existing data related to the location. The location input to computer 302 is geo-coded by geocoder 318, i.e., is assigned a longitude and latitude, and, if desired, the satellite image data is analyzed, either by server computer 306 or other computing machinery coupled to server computer 306, to see if obstructions such as trees, buildings, etc. exist on or around the geo-coded location input to computer 302. Further, server 306 accesses data from that location, and nearby locations, to see whether services have been successful in the past. So, for example, a previous tenant/owner may have had satellite services from a service provider at the requested location. By checking in profiles database 310 for the geo-coded location, there would be a record for that location that prior services were adequately provided.

Further, nearby locations may also have data that indicates successful adequate or unsuccessful inadequate provision of satellite services at those locations. Location data database 312 can be accessed to determine the proximity of the requested location to other locations with successful and/or unsuccessful installations. Service data database 314 can be accessed to see if service records exist for the requested location and/or nearby locations, and, if site surveys have been performed in the area, site survey data database 316 can be accessed to determine what information can be used in the present query.

Once the data requested from each database 308-316 is gathered, or while the data is being gathered and compiled, a weighting is assigned by server computer 306, via tagger 320, to each piece of data to indicate the importance of that piece of data to the overall determination of a successful installation, using adaptive and predictive rules programmed into tagger 320. So for example, and not by way of limitation, if the address that is requesting service has a record in profile database 310 of having prior service for satellite television that was successful for several years, such data can be adapted or used to predict a high likelihood of success if a subsequent request for satellite television services from computer 302 is received. Further, if service data database 314 received only one service call in several years for that address and nearby addresses, and nearby addresses have had recent successful installations, that data would also receive high weightings from server computer 306. If there has not been any prior service to a specific address/location, that data alone does not have much bearing on whether an installation would be successful, so such data might receive a low weighting. Other data, such as satellite photography, prior visit notations, purchased database information, or other data that can affect the signal characteristics can also be entered into server computer 306, where through use of the data and additional installations, weightings, adaptations to other addresses, and predictions for future installations can be performed.

Once a sufficient amount of data points is amassed by server 306, or all of the available data is accumulated, the weightings and the values of each data point are combined and compared to a standard for whether a particular installation at the requested location would adequately provide the requested service. For example, and not by way of limitation, a survey may be done of locations that do have successful installations and parameters from those locations are entered into server 306. Weightings of the parameters entered for those locations are added and simulations can be performed such that a desired rate of successful installations, e.g., 95%, can be assigned. Once the database is populated with successful installations, new data can be assigned the same weightings for new addresses, and as additional installations are performed, the weightings for various data points and data types can be changed based on the success and failure rates of new installations. Eventually, adaptive and predictive rules are formed based on the addition of new data and addition of results from new installations such that the success and failure prediction can be made from a small number of data points that are weighted most heavily. Again, for example and not by way of limitation, if a given location has a minimal southern exposure, it is not very likely that the location will be able to receive satellite data because the signal from the satellites will not reach the local antenna with enough strength to be processed. Such a data point would be highly weighted toward failure, and that parameter, when present in a request for new satellite services at another location, can be used to predict the failure of installation fairly accurately at the new location. The service-ability system may implement a machine learning model, such as one or more of Bayesian Learning, Neural Nets, Logistic Regression, Linear Regression, K-Nearest Neighbor, etc.

So, for example, and not by way of limitation, the address input to computer 302 is 123 Main Street, Anytown, Calif. Optionally, interface 304 would input this address to a satellite mapping service, e.g., Google maps, and return a satellite image of that address to the computer 302 to verify that it is the proper location, and the user of computer 302 would verify the image or re-enter the address to obtain the proper image.

Once the address is confirmed, or, optionally, once the address is entered into computer 302 and sent to interface 304, the address is geocoded by server 306 in geocoder 318 and the geocode is used to search databases 308-316 for information on that geocoded location and nearby locations (within a given radius of the geocoded location, e.g., 500 yards). The data that is returned to server computer 306 for tagging by tagger 320, and server computer compiles the aggregate weightings and values for reporting the probability of an adequate installation at the location. This is reported back to computer 302 via interface 304 after comparison of the aggregated values to a predetermined standard for success (adequate supply of services) or failure (inadequate supply of services).

Server 306 can also analyze the mapping image data to see if certain blockage conditions exist: if 123 Main Street is directly north of a 10 story building at 122 Main Street, and 123 Main Street is a single story structure with no exposure to the signal source (e.g., the satellite delivering the signal requested), this lack of exposure can be determined by analyzing the satellite image data without requiring a visit to the property (a site survey) or accessing any other database. Such data can be determined from any of the databases 308-316, or other databases, and the analysis can be performed across databases.

Further, server 306 can determine if a site survey is needed or desired based on the data being analyzed. For example, if there has been a site survey of the property next door, server 306 can analyze the data in that site survey to see if a site survey is needed for the requested location. If the server 306 determines that the predetermined standard for success is not met by the aggregated probabilities, it can be suggested or determined that a site survey should be performed on the requested location, which data is then placed into the proper databases 308-316 for future determinations of successful installations in the nearby area.

As can be seen in this example, some of the databases 308-316 are public in nature, while other databases 308-316 may be proprietary or otherwise unavailable to the public, because of the nature of the data being stored in the various databases 308-318. Server 306 may have access to the data that is otherwise unavailable to the public and augments such public data analysis with the additional proprietary data to arrive at a more accurate determination of successful installations.

Weightings of the Parameters

FIG. 4 illustrates an example of data points being used to determine probability of a successful installation in one or more embodiments.

Chart 400 illustrates how various attributes 402 can be weighted to determine a probability of a successful installation. For example, the geocoded address 404 is important because it is important to note not only whether installation will be possible, but whether service can be provided over a period of time.

A visual inspection 406 of satellite data, from a Customer Service Representative (CSR), may also provide some insight to the determination. If the CSR notices large areas of blockage of the signal source, there may be an issue; however, the CSR's viewpoint may not be completely accurate, so a smaller weighting is assigned to visual inspection 406.

Trees 408 are also considered an obstruction, and both customer and CSR viewpoints are reviewed and weighted. For existing addresses, e.g., addresses that have or previously had services, the reasons for not having service shown in service records 410 are relatively important in determining future service provision to that address. If a customer merely moved away, and there has not been service at this location because there has not been a request, that may have a different value than if service was installed and then canceled because service was intermittent and there were numerous service calls to that address. However, this information weighs heavily on the determination for successful installation of services at this location.

Additionally, if nearby service records 412 indicate successful or unsuccessful delivery of services, such records would assist in the determination, but not as heavily as to the particular address in question. An exposure 414 in the direction of the signal source, e.g., a southern exposure, also weighs heavily in determination of successful delivery of services.

Weightings 416 are assigned, and values are assigned to the geolocation, and are then added up and compared to values of successful installations, whether in the local area of the geocoded location or across other geographical areas. Depending on the comparison, the probability of a successful installation will indicate success, failure, or some possibility of success for a given location.

Process Flow

Figure 5:
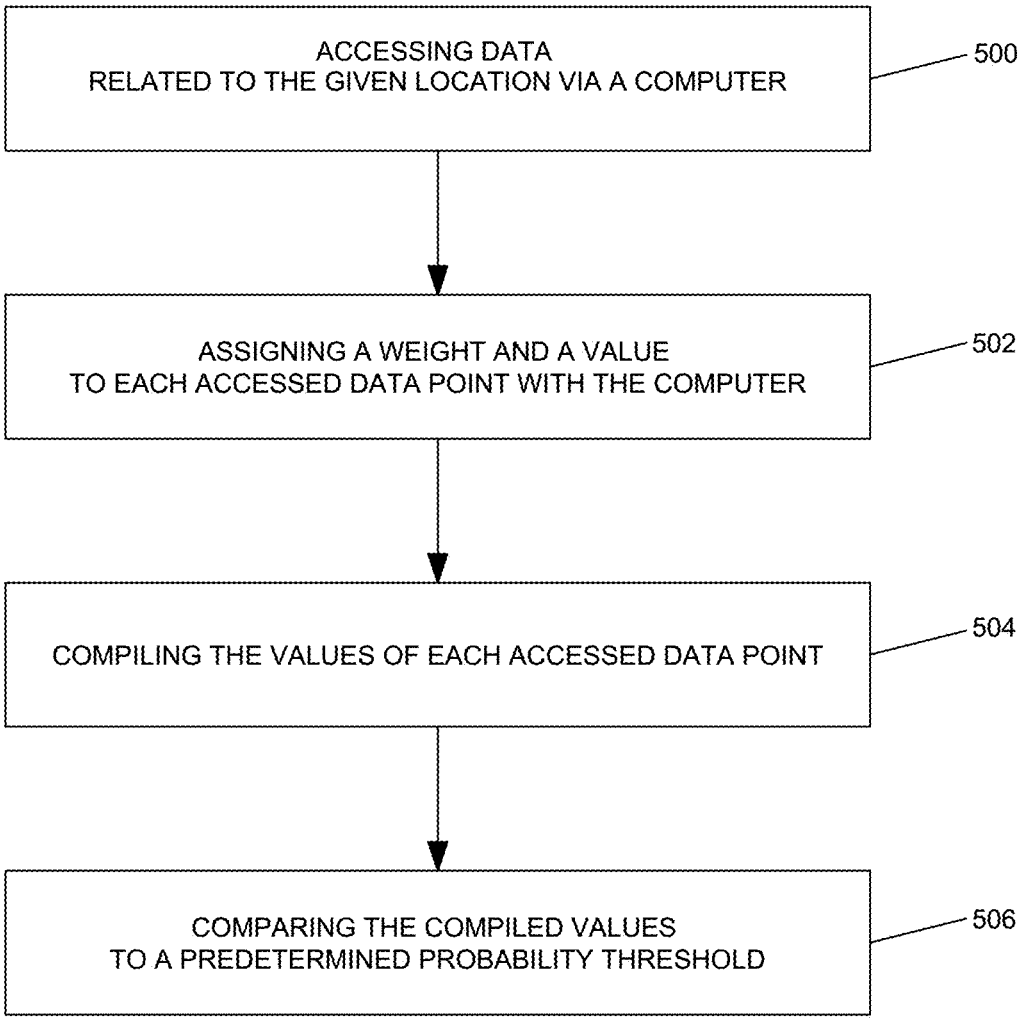
FIG. 5 is a flow diagram of an example process embodiment.

FIG. 5 illustrates a flow diagram in accordance with one or more possible embodiments of the service-ability system.

Box 500 illustrates accessing data related to the given location via a computer.

Box 502 illustrates assigning a weight and a value to each accessed data point with the computer.

Box 504 illustrates compiling the values of each accessed data point.

Box 506 illustrates comparing the compiled values to a predetermined probability threshold.

CONCLUSION

The present disclosure describes embodiments for determining a probability of a proper installation of satellite broadcast reception equipment at a given location. A method in accordance with one or more embodiments comprises accessing data related to the given location via a computer, assigning a weight and a value to each accessed data point with the computer, compiling the values of each accessed data point, and comparing the compiled values to a predetermined probability threshold.

Such a method further optionally comprises the proper installation being determined for a specific requested service, the data related to the given location comprising proprietary data of a service provider, the accessed data being determined through a web-based questionnaire, the data related to the given location comprising at least one of a street address, exposure of the given location in a given direction, prior services provided to the given location, and obstructions at the given location, at least one piece of accessed data being weighted differently based on a type of requested service, the probability being determined prior to performing a site survey of the given location, and when the comparison of the compiled values fails to meet the predetermined probability threshold, a site survey of the given location is requested.

A service-ability system for determining a probability of a proper installation of satellite broadcast reception equipment at a given location in accordance with one or more embodiments comprises a geocoder for determining a geocode for the given location, a server, coupled to the geocoder, for accessing data points associated with the given location, and a tagger for assigning a weight and a value to each accessed data point, wherein the server compiles the values of each accessed data point and compares the compiled values to a predetermined probability threshold.

Such a service-ability system further optionally comprises the proper installation being determined for a specific requested service at the given location, the data points associated with the given location comprising proprietary data of a service provider, the accessed data being determined through a web-based questionnaire, the data points associated with the given location comprising at least one of a street address, exposure of the given location in a given direction, prior services provided to the given location, and obstructions at the given location, at least one accessed data point being weighted differently based on a type of requested service, the probability being determined prior to performing a site survey of the given location, and when the comparison of the compiled values fails to meet the predetermined probability threshold, a site survey of the given location is requested.

The foregoing description of one or more embodiments been presented for the purposes of illustration and description. It is not intended to be exhaustive or to limit the disclosure to the precise form disclosed. Many modifications and variations are possible in light of the above teaching.

Applicant reserves the right to file broader claims, narrower claims, or claims of different scope or subject matter, in one or more continuation or divisional applications in accordance with the full breadth of the present disclosure, and the full range of equivalents.

What is claimed is:

1. A method for determining a serviceability of a location for installation of equipment for receiving one or more signals broadcast by one or more satellites of a satellite broadcast system in response to a user-provided service request, comprising:

accessing, via a computer data points describing a plurality of parameters of the location affecting reception of the one or more signals;

compiling, with the computer, the accessed data points;

assigning, with the computer, a weight and a value to each parameter according to the compiled data points;

compiling, with the computer, the weighted values of the parameters; and comparing, with the computer, the compiled weighted values to a predetermined probability threshold; and determining, with the computer, the serviceability of the location for installation of the equipment;

wherein the satellite broadcast system provides a plurality of services, the user-provided service request is a request for a selected service of the plurality of services provided by the satellite broadcast system, and the weights assigned to each parameter vary according to the selected service.

2. The method of claim 1, wherein the particular service is provided by a particular one of the one or more satellites.

3. The method of claim 1, wherein the data points describing a plurality of parameters of the location affecting reception of the one or more signals comprises proprietary data of the satellite broadcast system.

4. The method of claim 1, wherein the user-provided service request is provided through a web-based questionnaire.

5. The method of claim 1, wherein the data points describing the plurality of parameters of the location comprises at least one of a street address, exposure of the location in a given direction, prior services provided to the location, and obstructions at the location.

6. The method of claim 1, wherein the location is determined to be unserviceable for receiving the particular service prior to performing a physical site survey of the location, and the method further comprises determining, based on the data points, one or more solutions to make the location serviceable for receiving the particular service.

7. The method of claim 1, wherein when the comparison of the compiled values fails to meet the predetermined probability threshold, a site survey of the location is requested.

8. The method of claim 1, wherein the data points describing the plurality of parameters of the location comprise data describing whether the installation of the equipment is permitted at the location.

9. A system for determining a serviceability of a location for installation of equipment for receiving one or more signals broadcast by one or more satellites of a satellite broadcast system in response to a user-provided service request, comprising:

a geocoder for determining a geocode for the location;

a server, coupled to the geocoder, for accessing data points describing a plurality of parameters of the location affecting reception of the one or more signals and for compiling the accessed data points; and a tagger for assigning a weight and a value to each parameter, according to the compiled data points, wherein the server further compiles the weighted values of the parameters, compares the compiled weighted values to a predetermined probability threshold, and determines the serviceability of the location for installation of the equipment;

wherein the satellite broadcast system provides a plurality of services, the user-provided service request is a request for a particular service of the plurality of services provided by the satellite broadcast system, and the weights assigned to each parameter vary according to the particular service.

10. The system of claim 9, wherein the particular service is provided by a particular one of the one or more satellites.

11. The system of claim 9, wherein the data points describing a plurality of parameters of the location affecting reception of the one or more signals comprises proprietary data of the satellite broadcast system.

12. The system of claim 9, wherein the user provided service request is provided through a web-based questionnaire.

13. The system of claim 9, wherein the data points describing the plurality of parameters of the location comprises at least one of a street address, exposure of the location in a given direction, prior services provided to the location, and obstructions at the location.

14. The system of claim 9, wherein the location is determined to be unserviceable for receiving the selected service prior to performing a physical site survey of the location, and the server further determines, based on the data points, one or more solutions to make the location serviceable for receiving the selected service.

15. The system of claim 9, wherein when the comparison of the compiled values fails to meet the predetermined probability threshold, a site survey of the location is requested.

16. The system of claim 9, wherein the data points describing the plurality of parameters of the location comprise data describing whether the installation of the equipment is permitted at the location.

* * * * *